US007959747B2

(12) United States Patent
Sun

(10) Patent No.: US 7,959,747 B2
(45) **Date of Patent: *Jun. 14, 2011**

(54) METHOD OF MAKING COLD ROLLED DUAL PHASE STEEL SHEET

(75) Inventor: Weiping Sun, Canton, MI (US)

(73) Assignee: Nucor Corporation, Charlotte, NC (US)

( * ) Notice: Subject to any disclaimer, the term of this patent is extended or adjusted under 35 U.S.C. 154(b) by 430 days.

This patent is subject to a terminal disclaimer.

(21) Appl. No.: 12/177,839

(22) Filed: Jul. 22, 2008

(65) Prior Publication Data

US 2009/0071574 A1 Mar. 19, 2009

Related U.S. Application Data

(63) Continuation-in-part of application No. 10/997,480, filed on Nov. 24, 2004, now Pat. No. 7,442,268.

(51) Int. Cl.
*C21D 8/02* (2006.01)

(52) U.S. Cl. ..... 148/603; 148/651; 148/652; 148/533

(58) Field of Classification Search ..... 148/320, 148/333–336, 533, 603, 651, 652, 660
See application file for complete search history.

(56) References Cited

U.S. PATENT DOCUMENTS

| | | | |
|---|---|---|---|
| 3,837,894 | A | 9/1974 | Tucker |
| 4,072,543 | A | 2/1978 | Coldren et al. |
| 4,361,448 | A | 11/1982 | Sippola |
| 4,376,661 | A | 3/1983 | Takechi et al. |
| 4,394,186 | A | 7/1983 | Furukawa |
| 4,398,970 | A | 8/1983 | Marder |
| 4,436,561 | A | 3/1984 | Takahashi et al. |
| 4,437,902 | A | 3/1984 | Pickens et al. |
| 4,609,410 | A | 9/1986 | Hu |
| 4,615,749 | A | 10/1986 | Satoh et al. |
| 4,708,748 | A | 11/1987 | Satoh et al. |
| 4,770,719 | A | 9/1988 | Hashiguchi et al. |
| 4,854,976 | A | 8/1989 | Era et al. |
| 5,312,493 | A | 5/1994 | Masui et al. |
| 5,328,528 | A | 7/1994 | Chen |
| 5,454,887 | A | 10/1995 | Fukui |

(Continued)

FOREIGN PATENT DOCUMENTS

AU 2005200300 A1 1/2005

(Continued)

OTHER PUBLICATIONS

Steel and Heat Treatment, Second Edition, Karl-Erik Thelning, Head of Research and Development Smedjebacken-Boxholm Stal AB, Sweden; Butterworths, printed in Great Britain by Mackagys of Chatham Ltd, Kent; pp. 436-437, 1984.

(Continued)

*Primary Examiner* — Deborah Yee
(74) *Attorney, Agent, or Firm* — Hahn Loeser & Parks, LLP

(57) ABSTRACT

A steel sheet having (a) a dual phase microstructure with a martensite phase and a ferrite phase and (b) a composition containing by percent weight: $0.01 \leqq C \leqq 0.2$; $0.3 \leqq Mn \leqq 3$; $0.05 \leqq Si \leqq 2$; $0.2 \leqq Cr+Ni \leqq 2$; $0.01 \leqq Al \leqq 0.10$; $0.0005 \leqq Ca \leqq 0.01$, with the balance of the composition being iron and incidental ingredients. Also, the steel sheet is made by a batch annealing method, and has a tensile strength of at least approximately 400 megapascals and an n-value of at least approximately 0.175.

18 Claims, 3 Drawing Sheets

U.S. PATENT DOCUMENTS

| | | | | |
|---|---|---|---|---|
| 5,470,403 | A | 11/1995 | Yoshinaga et al. | |
| 6,143,100 | A | 11/2000 | Sun | |
| 6,210,496 | B1 | 4/2001 | Takagi et al. | |
| 6,221,179 | B1 | 4/2001 | Yasuhara et al. | |
| 6,312,536 | B1 | 11/2001 | Omiya | |
| 6,423,426 | B1 | 7/2002 | Kobayashi et al. | |
| 6,440,584 | B1 | 8/2002 | Nagataki et al. | |
| 6,537,394 | B1 | 3/2003 | Osawa et al. | |
| 6,641,931 | B2 | 11/2003 | Claessens | |
| 6,666,932 | B2 | 12/2003 | Funakawa et al. | |
| 6,673,171 | B2 | 1/2004 | Hlady | |
| 6,676,774 | B2 | 1/2004 | Matsuoka et al. | |
| 6,702,904 | B2 | 3/2004 | Kami et al. | |
| 6,706,419 | B2 | 3/2004 | Yoshinaga et al. | |
| 6,709,535 | B2 | 3/2004 | Utsumi et al. | |
| 6,726,782 | B2 | 4/2004 | Nakai et al. | |
| 6,811,624 | B2 | 11/2004 | Hoydick | |
| 6,814,819 | B2 | 11/2004 | Matsuoka et al. | |
| 6,818,074 | B2 | 11/2004 | Matsuoka et al. | |
| 6,869,691 | B2 | 3/2005 | Nagataki et al. | |
| 6,982,012 | B2 | 1/2006 | Nomura et al. | |
| 7,090,731 | B2 | 8/2006 | Kashima et al. | |
| 7,118,809 | B2 | 10/2006 | Utsumi | |
| 7,311,789 | B2 | 12/2007 | Hoydick | |
| 7,381,478 | B2 | 6/2008 | Yokoi et al. | |
| 7,396,420 | B2 | 7/2008 | Matsuoka et al. | |
| 7,442,268 | B2 * | 10/2008 | Sun | 148/603 |
| 7,527,700 | B2 | 5/2009 | Kariya et al. | |
| 7,534,312 | B2 | 5/2009 | Yoshinaga et al. | |
| 7,553,380 | B2 | 6/2009 | Ikeda et al. | |
| 7,608,155 | B2 * | 10/2009 | Sun | 148/320 |
| 2003/0041932 | A1 | 3/2003 | Tosaka et al. | |
| 2003/0129444 | A1 | 7/2003 | Matsuoka | |
| 2004/0003774 | A1 | 1/2004 | Moore | |
| 2004/0035500 | A1 | 2/2004 | Ikeda et al. | |
| 2004/0047756 | A1 | 3/2004 | Rege et al. | |
| 2004/0074573 | A1 | 4/2004 | Funakawa et al. | |
| 2004/0118489 | A1 | 6/2004 | Sun | |
| 2004/0238080 | A1 | 12/2004 | Vandeputte et al. | |
| 2004/0238082 | A1 | 12/2004 | Hasegawa et al. | |
| 2005/0016644 | A1 | 1/2005 | Matsuoka et al. | |
| 2005/0019601 | A1 | 1/2005 | Matsuoka et al. | |
| 2006/0144482 | A1 | 7/2006 | Moulin | |
| 2006/0191612 | A1 | 8/2006 | Yoshida et al. | |
| 2007/0003774 | A1 | 1/2007 | McDaniel | |
| 2007/0144633 | A1 | 6/2007 | Kizu et al. | |
| 2009/0071574 | A1 | 3/2009 | Sun | |
| 2009/0071575 | A1 | 3/2009 | Sun | |
| 2009/0242085 | A1 | 10/2009 | Ikeda et al. | |

FOREIGN PATENT DOCUMENTS

| | | | |
|---|---|---|---|
| EP | 0969112 | * | 1/2000 |
| EP | 0969112 | A1 | 1/2000 |
| EP | 1191114 | A1 | 2/2001 |
| EP | 1291448 | A1 | 3/2003 |
| EP | 1338667 | A1 | 8/2003 |
| EP | 1431407 | * | 6/2004 |
| EP | 1666622 | A1 | 9/2004 |
| JP | 54033218 | | 3/1979 |
| JP | 55100934 | A | 8/1980 |
| JP | 56013437 | A | 2/1981 |
| JP | 58058264 | A | 4/1983 |
| JP | 61045788 | U | 3/1986 |
| JP | 61045892 | U | 3/1986 |
| JP | 08-246097 | | 9/1996 |
| JP | 10-251794 | | 9/1998 |
| JP | 2000239791 | A | 9/2000 |
| JP | 2000336455 | A | 12/2000 |
| JP | 2001089811 | A | 4/2001 |
| JP | 2001-220648 | | 8/2001 |
| WO | 2004059026 | A2 | 7/2004 |

OTHER PUBLICATIONS

U.S. Steel—Automotive Center—Comparison of Mechanical Properties; http://www.ussautomotive.com/auto/tech/mech—properties.htm, copyright 2005.

Resistance Spot Welding of Galvanized Steel: Part II. Mechanisms of Spot Weld Nugget Formation; S. A. Gedeon and T. W. Eagar; Metallurgical Transactions B; vol. 17B, Dec. 1986 pp. 887-901; Manuscript submitted Aug. 15, 1985.

Structural Steels; Effect of Alloying Elements and Structure on the Properties of Low-Carbon Heat-Treatable Steel; V. A. Mayshevskii, T. G. Semicheva, and E. I. Khlusova; Translated from Metallovedenie I Termischeskaya Obrabotka Metallov, No. 9, pp. 5-9, Sep. 2001.

What Happens to Steel During Heat Treatment? Part One: Phase Transformations by Daniel H. Herring, Apr. 9, 2007; http://www.industrialheating.com/CDA/Articles/Column/BNP_GUID_9-5-2006_A_1000000000000083813.

* cited by examiner

METHOD OF MAKING COLD ROLLED DUAL PHASE STEEL SHEET

RELATED APPLICATIONS

This application is a continuation-in-part of application Ser. No. 10/997,480, filed Nov. 24, 2004 now U.S. Pat. No. 7,442,268, which is hereby incorporated by reference.

BACKGROUND AND SUMMARY

The present invention is directed to a dual phase structured (ferrite and martensite) steel sheet product and a method of producing the same.

Applications of high strength steel sheets to automotive parts, electric apparatus, building components and machineries are currently increasing. Among these high strength steels, dual phase steel, which possess microstructures of martensite islands embedded in a ferrite matrix, is attracting more and more attention due to such dual phase steel having a superior combination of the properties of high strength, excellent formability, continuous yielding, low yield strength/tensile strength ratio and/or high work hardening. Particularly with respect to automotive parts, martensite/ferrite dual phase steels, because of these properties, can improve vehicle crashworthiness and durability, and also can be made thin to help to reduce vehicle weight as well. Therefore, martensite/ferrite dual phase steels help to improve vehicle fuel efficiency and vehicle safety.

The previous research and developments in the field of dual phase steel sheets have resulted in several methods for producing dual phase steel sheets, many of which are discussed below.

U.S. Patent Application Publication No. 2003/0084966A1 to Ikeda et al. discloses a dual phase steel sheet having low yield ratio, and excellence in the balance for strength-elongation and bake hardening properties. The steel contains 0.01-0.20 mass % carbon, 0.5 or less mass % silicon, 0.5-3.0 mass % manganese, 0.06 or less mass % aluminum, 0.15 or less mass % phosphorus, and 0.02 or less mass % sulfur. The method of producing this steel sheet includes hot rolling and continuous annealing or galvanization steps. The hot rolling step includes a step of completing finish rolling at a temperature of $(A_{\gamma 3}-50)$° C., meaning $(Ar_{r3}-50)$° C., or higher, and a step of cooling at an average cooling rate of 20° C. per second (° C./s) or more down to the $M_s$ point (defined by Ikeda et al. as the matrix phase of tempered martensite) or lower, or to the $M_s$ point or higher and the $B_s$ point (defined by Ikeda et al. as the matrix phase of tempered bainite) or lower, followed by coiling. The continuous annealing step includes a step of heating to a temperature of the $A_1$ point or higher and the $A_3$ point or lower, and a step of cooling at an average cooling rate of 3° C./s or more down to the $M_s$ point or lower, and, optionally, a step of further applying averaging at a temperature from 100 to 600° C.

U.S. Pat. No. 6,440,584 to Nagataki et al. is directed to a hot dip galvanized steel sheet, which is produced by rough rolling a steel, finish rolling the rough rolled steel at a temperature of $A_{r3}$ point or more, coiling the finish rolled steel at a temperature of 700° C. or less, and hot dip galvanizing the coiled steel at a pre-plating heating temperature of $A_{c1}$ to $A_{c3}$. A continuous hot dip galvanizing operation is performed by soaking a pickled strip at a temperature of 750 to 850° C., cooling the soaked strip to a temperature range of 600° C. or less at a cooling rate of 1 to 50° C./s, hot dip galvanizing the cooled strip, and cooling the galvanized strip so that the residence time at 400 to 600° C. is within 200 seconds.

U.S. Pat. No. 6,423,426 to Kobayashi et al. relates to a high tensile hot dip zinc coated steel plate having a composition comprising 0.05-0.20 mass % carbon, 0.3-1.8 mass % silicon, 1.0-3.0 mass % manganese, and iron as the balance. The steel is subjected to a primary step of primary heat treatment and subsequent rapid cooling to the martensite transition temperature point or lower, a secondary step of secondary heat treatment and subsequent rapid cooling, and a tertiary step of galvanizing treatment and rapid cooling, so as to obtain 20% or more by volume of tempered martensite in the steel structure.

U.S. Pat. Nos. 4,708,748 (Divisional) and 4,615,749 (Parent), both to Satoh et al., disclose a cold rolled dual phase structure steel sheet, which consists of 0.001-0.008 weight % carbon, not more than 1.0 weight % silicon, 0.05-1.8 weight % manganese, not more than 0.15 weight % phosphorus, 0.01-0.10 weight % aluminum, 0.002-0.050 weight % niobium and 0.0005-0.0050 weight % boron. The steel sheet is manufactured by hot and cold rolling a steel slab with the above chemical composition and continuously annealing the resulting steel sheet in such a manner that the steel sheet is heated and soaked at a temperature from $a \rightarrow \gamma$ transformation point to 1000° C. and then cooled at an average rate of not less than 0.5° C./s but less than 20° C./s in a temperature range of from the soaking temperature to 750° C., and subsequently at an average cooling rate of not less than 20° C./s in a temperature range of from 750° C. to not more than 300° C.

All of the above patents and the above patent publication are related to the manufacture of dual phase steel sheets using a continuous annealing method. Compared to batch annealing, continuous annealing can provide steel sheets which exhibit more uniform mechanical properties. However, the formability and drawability of continuous annealed steel sheets are generally inferior to the formability and drawability of steel sheets produced by batch annealing. A need is thus still called for to develop a new manufacturing method to produce dual phase steel sheets. This appears particularly important in North America, where a number of steel manufacturers have no continuous annealing production lines to perform controlled cooling.

The present invention permits the use of a batch annealing method, which greatly improves the ability of producing cold rolled steel sheets, by providing less demanding processing requirements than continuous annealing methods, and advantageously provides a steel sheet that exhibits improvements over the prior dual phase steel sheet. The present batch annealing method can be carried out by most steel manufacturers using a facility that is less process restrictive and dramatically less capital cost than the continuous annealing facilities required by prior dual phase steels.

The present invention is a steel sheet having a dual phase microstructure formed by hot rolling and cooling the steel sheet, comprising a martensite phase less than about 35% by volume embedded in a ferrite matrix phase of at least 50% by volume. The steel sheet also has a composition comprising carbon in a range from about 0.01% by weight to about 0.2% by weight, manganese in a range from about 0.3% by weight to about 3% weight, silicon in a range from about 0.05% by weight to about 2% by weight, chromium and nickel in combination from about 0.2% by weight to about 2% by weight, where chromium if present is in a range from about 0.1% by weight to about 2% by weight, and nickel if present is in an amount up to 1%, aluminum in a range from about 0.01% by weight to about 0.10% by weight and nitrogen less than about 0.02% by weight, where the ratio of Al/N is more than 2, and calcium in a range from about 0.0005% by weight to about 0.01% by weight, with the balance of the composition comprising iron and incidental ingredients. Additionally, the steel sheet comprises properties comprising a tensile strength of more than about 400 megapascals and an n-value of at least about 0.175. Alternately, the ratio of Al/N may be more than 2.5, and may be more than about 3.

In various embodiments, the steel composition may have molybdenum in an amount up to about 0.5% by weight, copper in an amount up to about 0.8% by weight, phosphorous in an amount up to about 0.1% by weight, and sulfur in an amount up to about 0.03% by weight. In some embodiments, the composition may additionally include titanium in an amount up to about 0.2% by weight, vanadium in an amount up to about 0.2% by weight, niobium in an amount up to about 0.2% by weight, and boron in an amount up to about 0.008% by weight.

Alternately, the dual phase microstructure may have a martensite phase between about 3% by volume and about 35% by volume of the microstructure formed by hot rolling, and more particularly from about 10% by volume to about 28% by volume after hot rolling. In addition or in the alternative, the ferrite phase may be between about 60% and about 90% by volume, or between about 65% and about 85% by volume after hot rolling. The steel sheet may include one or both of a zinc coating or a zinc alloy coating.

The present disclosure provides a steel sheet made by a batch annealing method that comprises: (I) hot rolling a steel slab having the above composition into a hot band at a hot rolling termination temperature in a range between about ($A_{r3}$-60)° C. and about 980° C. (1796° F.), (II) cooling the hot band at a mean rate at least about 5° C./s (9° F./s) to a temperature not higher than about 750° C. (1382° F.), (III) coiling the cooled band to form a coil at a temperature higher than the martensite formation temperature, (IV) cooling the coil to a temperature lower than the martensite formation temperature to form a dual phase microstructure comprising a martensite phase of less than 35% by volume and a ferrite phase of more than 50% by volume, (V) cold rolling the band to a desired steel sheet thickness, with a total reduction of at least about 35%, (IV) annealing the cold rolled steel sheet in a batch furnace at a temperature higher than about 500° C. (932° F.) but lower than about the $A_{c3}$ temperature for longer than about 60 minutes, and (VII) cooling the annealed steel sheet to a temperature lower than about 400° C. (752° F.).

The steel slab prior to hot rolling may have a thickness between about 25 and 100 millimeters. Alternately, the steel slab may be thicker than 100 millimeters, such as between about 100 millimeters and 300 millimeters, but in such thicker slabs preheating may be needed before hot rolling.

Alternately, the presently disclosed method may comprise: (J) hot rolling a steel slab having the above composition into a hot band at a hot rolling termination temperature in a range between about ($A_{r3}$-30)° C. and about 950° C. (1742° F.), (II) cooling the hot band at a mean rate at least about 10° C./s (18° F./s) to a temperature not higher than about 650° C. (1202° F.), (III) coiling the cooled band to form a coil at a temperature higher than the maltensite formation temperature, (IV) cooling the coil to a temperature lower than the martensite formation temperature to form a dual phase microstructure comprising a martensite phase of less than 35% by volume and a ferrite phase of more than 50% by volume, (V) cold rolling the band at about ambient temperature to a desired steel sheet thickness, with a total reduction from about 45% to about 85%, (VI) annealing the cold rolled steel sheet in a batch furnace to a temperature higher than about 650° C. (1202° F.) but lower than about the $A_{c1}$ temperature for longer than about 60 minutes up to about 8 days, and (VII) cooling the annealed steel sheet to a temperature lower than about 300° C. (572° F.).

The invention is now discussed in connection with the accompanying Figures and the Examples as best described below.

DETAILED DESCRIPTION OF THE DISCLOSURE

Figure 1:
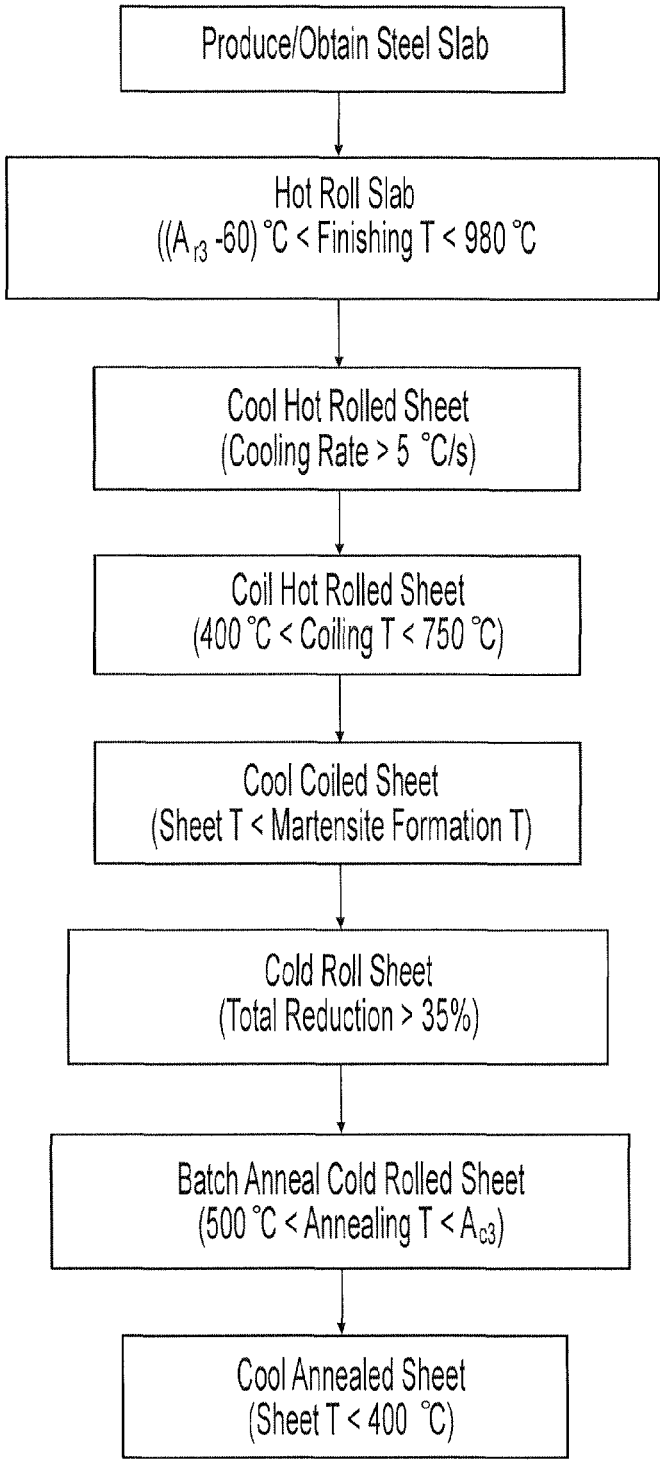
FIG. 1 is a flow chart illustrating an embodiment of the process of the present invention.

The present disclosure is directed to a cold rolled, low carbon, dual phase steel sheet and a method of making such a steel sheet. The steel sheet has a composition comprising carbon in a range from about 0.01% by weight to about 0.2% by weight, manganese in a range from about 0.3% by weight to about 3% weight, silicon in a range from about 0.05% by weight to about 2% by weight, chromium and nickel in combination from about 0.2% by weight to about 2% by weight, where chromium if present is in a range from about 0.1% by weight to about 2% by weight, and nickel if present is in an amount up to 1%, aluminum in a range from about 0.01% by weight to about 0.10% by weight and nitrogen less than about 0.02% by weight, where the ratio of Al/N is more than 2, and calcium in a range from about 0.0005% by weight to about 0.01% by weight, with the balance of the composition comprising iron and incidental ingredients.

In various embodiments, the steel composition may have molybdenum in an amount up to about 0.5% by weight, copper in an amount up to about 0.8% by weight, phosphorous in an amount up to about 0.1% by weight, and sulfur in an amount up to about 0.03% by weight. In some embodiments, the composition may additionally include titanium in an amount up to about 0.2% by weight, vanadium in an amount up to about 0.2% by weight, niobium in an amount up to about 0.2% by weight, and boron in an amount up to about 0.008% by weight.

The steel sheet exhibits high tensile strength and excellent formability, in that the steel sheet has a tensile strength of more than about 400 megapascals (MPa) and an n-value of more than about 0.175, and more particularly a tensile strength of at least about 450 MPa, and an n-value of at least about 0.18. The steel sheet manufactured according to the present method possesses a microstructure comprising less than about 35% by volume martensite islands dispersed in a ferrite matrix phase of more than 50% by volume formed in the as-hot-rolled sheet after cooling and before cold rolling. Alternately, the microstructure of the steel sheet may have between about 3% and 30% by volume martensite islands embedded in a ferrite matrix phase formed in the as-hot-rolled sheet after cooling and before cold rolling.

The ferrite matrix phase is the continuous phase more than 50% by volume in which the martensite phase of up to about 35% is dispersed. The ferrite matrix phase may be less than 90% by volume and is formed by hot rolling and subsequent cooling before cold rolling. Alternately or in addition, the ferrite matrix phase between about 60% and about 90% by volume, and may be more than 65% of the microstructure by volume formed by hot rolling and subsequent cooling before cold rolling.

The steel sheet of the present disclosure can be used after being formed (or otherwise press formed) as cold-rolled steel, or in an "as-annealed" state, or optionally can be coated with zinc and/or zinc alloy, for instance, for automobiles, electrical appliances, building components, machineries, and other applications.

As described in more detail below, the dual phase steel sheet has improved properties of high tensile strength and excellent formability (n-value, namely the strain hardening exponent of the steel sheet). The ranges for the content of various ingredients such as carbon in the composition of the resultant steel sheet, and reasons for the ranges of ingredients in the present steel composition are described below.

Carbon in the present steel composition provides hardenability and strength to the steel sheet. Carbon is present in an amount of at least about 0.01% by weight in order to enable the desired martensite and ferrite phases and strength properties to the steel sheet. In order to enable the formation of martensite contributing to the improvement of the strength properties, carbon may be about 0.02% by weight. Since a large amount of carbon in the present steel composition has been found to markedly deteriorate the formability and weldability of the steel sheet, the upper limit of the carbon content is about 0.2% by weight for an integrated hot mill. Alternatively, the carbon content in the present steel may be no more than about 0.12% by weight for steel sheet made by hot mills at compact strip production (CSP) plants to provide excellent castability of the steel sheet. Alternatively, carbon may be present in a range from about 0.03% by weight to about 0.1% by weight in the present steel.

Manganese of between about 0.3% and 3% by weight in the present steel composition is another alloy enhancing the strength of steel sheet. An amount of at least about 0.3% by weight of manganese has been found in order to provide the strength and hardenability of the steel sheet. Alternatively, in order to enhance the stability of austenite in the present steel composition and at least about 3% by volume of a martensite phase in the steel sheet, the amount of manganese in the present steel composition should be more than about 0.5% by weight. On the other hand, when the amount of manganese exceeds about 3% by weight, it has been found that the weldability of the steel sheet of the present steel composition is adversely affected. Alternatively, the amount of manganese may be less than about 2.5% by weight or between about 0.5% and about 2.5% by weight in the present steel.

Silicon in the range of about 0.05% and about 2% in the present steel composition has been found to provide the desired strength, and not significantly impairing the desired ductility or formability of the steel sheet. Silicon in this range also has been found in the present steel composition to promote the ferrite transformation and delay the pearlite transformation. As pearlite is not desired in the ferrite matrix of the steel sheet, the present composition has silicon in an amount in the range of about 0.05% and about 2%. When the content of silicon exceeds about 2% by weight in the present steel, it has been found that the beneficial effect of silicon is saturated and accordingly, the upper limit of silicon content is about 2% by weight. Alternatively, silicon may be present in a range from about 0.08% by weight to about 1.5% by weight, or from about 0.1% by weight to about 1.2% by weight in the present steel.

Chromium and nickel in combination in an amount between about 0.2% by weight and about 2% by weight in the present steel composition has been found effective for improving the hardenability and strength of the steel sheet. Chromium and nickel in such amounts has also been found useful in the present steel for stabilizing the remaining austenite and promoting the formation of martensite while having minimal or no adverse effects on austenite to ferrite transformation. These properties have been provided in the present steel by a combination of chromium and nickel from about 0.2% by weight to about 2% by weight where chromium if present is in an amount between about 0.1% and about 2% by weight and nickel if present in an amount up to about 1% by weight. Alternatively, the combination of chromium and nickel may be present in a range from about 0.2% by weight to about 1.5% by weight, or from about 0.3% by weight to about 1.5% by weight in the present steel.

Aluminum is present in the present steel composition to deoxidize the steel composition and react with nitrogen, if any, to form aluminum nitrides. Theoretically, the acid-soluble amount of (27/14) N, i.e., 1.9 times the amount of nitrogen, is required to fix nitrogen as aluminum nitrides. Practically, however, it has been found that the ratio of Al/N needed in the present steel composition is above about 2, and in some cases above 2.5. Alternately, the ratio of Al/N may be controlled above about 3, and in some cases above 3.5. At least 0.01% by weight of aluminum is effective as a deoxidation element in the present steel composition. When the content of aluminum exceeds about 0.1% in the present steel, on the other hand, the ductility and formability of the steel sheet has been found to significantly degrade. Hence, the amount of aluminum in the present steel is between about 0.01% and about 0.1% by weight. Alternatively, aluminum may be present in a range between about 0.015% and about 0.09% by weight, or in the range between about 0.02% and about 0.08% by weight in the present steel.

Calcium is used in the present steel composition to assist the shape of sulfides, if any. Calcium assists in reducing the harmful effect due to sulfur, if any, and improves the stretch flangeability and fatigue property of the present steel sheet. At least about 0.0005% by weight of calcium has been found to be needed in the present steel composition to provide these beneficial properties. On the other hand, this beneficial effect has been found to be saturated when the amount of calcium exceeds about 0.01% by weight in the present steel composition, so that is the upper limit specified for calcium. Alternatively, calcium may be present in a range from about 0.0008% by weight to about 0.009% by weight, or from about 0.001% by weight to about 0.008% by weight in the present steel.

Phosphorus is generally present as a residual ingredient in iron sources used in steelmaking. In principle, phosphorus in the present steel composition exerts an effect similar to that of manganese and silicon in view of solid solution hardening. In addition, when a large amount of phosphorus is added to the present steel composition, however, the castability and rollability of the steel sheet has been found to deteriorate. Also, the segregation of phosphorus at grain boundaries of the present composition has been found to result in brittleness of the steel sheet, which in turn impairs its formability and weldability. For these reasons, the upper limit of phosphorus content in the present steel composition is about 0.1% by weight. Alternatively, the upper limit of phosphorus may be about 0.08% by weight, or about 0.06% by weight in the present steel.

Sulfur is not usually added to the present steel composition because as low as possible sulfur content is desired. A residual amount of sulfur may be present, depending on the steel making technique that is employed in making the present steel composition. However, the present steel composition contains manganese, so that residual sulfur if present typically is precipitated in the form of manganese sulfides. On the other hand, since a large amount of manganese sulfide precipitate greatly deteriorates the formability and fatigue properties of the present steel sheet, the upper limit of sulfur content is about 0.03% by weight. Alternatively, the upper limit of sulfur may be about 0.02% by weight, or about 0.01% by weight in the present steel.

When nitrogen exceeds about 0.02% by weight in the present steel composition, it has been found that the ductility and formability of the steel sheet are significantly reduced. Accordingly, the upper limit of nitrogen content is about 0.02% by weight in the present steel composition. Alternatively, the upper limit of nitrogen may be about 0.015% by weight, or about 0.01% by weight in the present steel.

Boron, even in a small amount, is very effective for improving the hardenability and strength of the steel sheet in the present steel composition. However, when boron is added in excess, the rollability of the steel sheet is found to be significantly lowered. Also with excess amounts of boron the segregation of boron at grain boundaries deteriorates the formability. For these reasons, the upper limit of boron content in the present steel composition is about 0.008% by weight. Alternatively, the upper limit of boron may be about 0.006% by weight, or about 0.005% by weight in the present steel. It is also possible that no boron is present in the present steel sheet.

Molybdenum in the present steel composition is effective for improving the hardenability and strength of the steel sheet. However, excess addition of molybdenum results in a saturated effect that promotes the formation of an undesired bainite phase. Furthermore, molybdenum is expensive. The upper limit for molybdenum in the present steel composition is about 0.5% by weight. Alternately, the upper limit for molybdenum may be about 0.3% by weight, or about 0.2% by weight in the present steel.

Copper may be present as a residual ingredient in iron sources, such as scrap, used in steelmaking. Copper as an alloy in the present steel composition is also effective for improving the hardenability and strength of the steel sheet. However, excess addition of copper in the steel composition has been found to significantly deteriorate the surface quality of the steel sheet. Copper is also expensive. The upper limit for copper in the steel composition is about 0.8% by weight. Alternatively, the upper limit for copper may be about 0.6% by weight, or about 0.4% by weight in the present steel.

In the present steel composition, titanium, vanadium, and/or niobium may also be used as an alloy and have a strong effect on retarding austenite recrystallization and refining grains. Titanium, vanadium, or niobium may be used alone or in any combination in the steel composition. When a moderate amount of one or more of them is added, the strength of the steel sheet is markedly increased. These elements are also useful in the present steel composition to accelerate the transformation of austenite phase to ferrite phase in the steel microstructure. However, when each of these elements alone or in combination exceeds about 0.2% by weight, an unacceptable large amount of the respective precipitates is formed in the present steel sheet. The corresponding precipitation hardening becomes very high, reducing castability and rollability during manufacturing the steel sheet, and also unacceptably deteriorating the formability of the present steel sheet when forming or press forming the produced steel sheet into final parts. Accordingly, the present steel composition has no more than about 0.2% by weight of titanium, vanadium, and/or niobium. Alternatively, the upper limit of each of titanium, vanadium, and/or niobium may be about 0.15% by weight in the present steel.

Incidental ingredients and other impurities should be kept to as small a concentration as is practicable with available iron sources and additives with available purity used in steelmaking. Incidental ingredients are typically the ingredients arising from use of scrap metals and other additions in steelmaking, as occurs in preparation of molten composition in a steelmaking furnace such as an electric arc furnace (EAF).

The presently disclosed process to produce a dual phase steel composition requires a less demanding and restrictive facility and processing requirements. By the present process, dual phase steel composition of less than 35% by volume martensite phase in a continuous ferrite phase of more than 50% by volume can be made directly by hot rolling. As a result, the equipment, such as the annealing furnace and associated equipment for batch annealing (also known as box annealing), can be much less expensive than equipment for conducting continuous annealing required by prior processes. As a result, the disclosed process can be carried out at most existing compact strip or CSP mills or carried out at most existing integrated mills with a great cost advantage.

An embodiment of the disclosed process comprises the following steps:

i. Obtain or produce as a starting material a thin steel slab having a composition within the ranges disclosed above, and having a thickness suitable for hot rolling into a hot rolled band. Hot rolled band is also referred to as a hot rolled steel sheet. A thin slab can be produced from a molten steel having a composition within the ranges disclosed above by using, for instance, a continuous slab caster or an ingot caster.

ii. Hot roll the steel slab into a hot band and complete the hot rolling process at a termination or finishing temperature in a range between about ($A_{r3}$-60)° C. and about 980° C. (1796° F.), in order to obtain a fine-grained ferrite matrix capable of producing an as-hot-rolled sheet with a microstructure of more than 50% ferrite phase by volume with a martensite phase of less than 35% dispersed therein. The total draft (also known as reduction) used during hot rolling is more than 50%, or may be more than 75%.

iii. Cool the hot rolled steel sheet, after completing hot rolling, at a mean rate not slower than about 5° C./s (9° F./s) to a temperature not higher than about 750° C. (1382° F.).

iv. Coil the hot rolled steel by a coiler, when the hot band has cooled to a temperature higher than about 400° C. (752° F.) and not higher than about 750° C. (1382° F.). A conventional coiler may be used. Then, cool the coiled sheet to a temperature lower than the martensite formation temperature, or the martensite start temperature, to form martensite islands of less than 35% by volume embedded in a ferrite matrix. The ferrite phase is thus more than 50% by volume and may be more than 60% or 65% by volume in the as-hot-rolled sheet.

v. As an optional step, pickle the above hot rolled coil to improve the surface quality.

vi. Cold roll the hot rolled and optionally pickled coil to a desired steel sheet thickness at a desired time. Cold rolling can be performed at a conventional cold rolling mill, such as continuous tandem cold rolling mill or a reversing cold rolling mill, and performed at about ambient temperature, or about room temperature. The total draft or reduction by cold rolling may be more than about 35%.

vii. Batch anneal the cold rolled steel sheet in a batch annealing furnace at a temperature higher than about 500° C. (932° F.) but lower than about the $A_{c3}$ temperature, and alternately lower than about the $A_{c1}$ temperature. The sheet may be annealed in the furnace for longer than about 60 minutes. Alternately, the sheet may be annealed longer than about 90 minutes, or longer than about 180 minutes. The length of the annealing time may vary with the weight of the coil and the size of the furnace, and may be up to about 7 days, or 8 days, or longer.

viii. Cool the annealed steel sheet to a desired handling temperature. The final product properties in the present steel sheet are not dependent on the specific cooling rates or cooling patterns for the annealed sheet. Conventional batch anneal cooling conditions at most existing steel mills are suitable for the process.

ix. As an optional step, apply a coating, such as a zinc coating and/or a zinc alloy coating, to the steel sheet. The coating may improve the corrosion resistance of the steel sheet. The "as-annealed" sheet or coated sheet may be formed or press formed into a desired end shape for a final application.

After hot rolling, the coiling step occurs at a temperature above the martensite formation temperature, or the martensite start temperature. The martensite formation temperature is the temperature at which martensite begins to form when cooling. The martensite formation temperature may vary with the steel composition, but may be between about 300° C. and about 450° C.

After coiling the hot-rolled sheet, the coil then cools to below the martensite formation temperature, obtaining a dual phase microstructure having a martensite phase no more than about 35% by volume in a ferrite matrix phase of more than 50% after hot rolling and cooling and before cold rolling. The martensite phase may be between about 3% and 30% by volume in the ferrite matrix phase after hot rolling. Alternately or in addition, the martensite phase may be between about 8% and about 30% by volume in the ferrite matrix phase after hot rolling, and may be between about 10% and about 28% by volume in the ferrite matrix phase after hot rolling and cooling and before cold rolling.

The ferrite phase is more than 50% and may be less than 90%. Alternately or in addition, the ferrite phase is more than 60% and less than 90% by volume, or may be more than 65% and less than 85% by volume after hot rolling. While the ferrite phase may contain neither precipitates nor inclusions and no other microstructure phases present in the steel sheet, in practice it is difficult to obtain a strictly dual phase material. While the ferrite phase may contain neither precipitates nor inclusions and no other microstructure phases present in the steel sheet, in practice it is difficult to obtain a strictly dual phase material. Although not desired, there may be a small amount of residual or incidental phases in the sheet, such as pearlite and/or bainite. The sum of residual or incidental phases is less than 15% by volume, and usually less than 8% by volume.

The amount of martensite and ferrite in the microstructure of the present dual phase steel is formed by hot rolling and is not substantially affected by the cold rolling and the batch annealing processes. After annealing the cold rolled steel sheet, the ferrite grain size becomes larger, and the strain hardening exponent of the steel sheet, or n-value, increases. The batch annealing step may be used to temper the martensite and decrease dislocation density. If present, residual pearlite may be dissolved in the annealing step.

The present process is for producing a dual phase steel sheet having high tensile strength and excellent formability as follows:

i. Produce or obtain as a starting material a thin steel slab, typically with a thickness ranging from about 25 to about 100 mm, for instance using a CSP facility, to form a steel composition including (in weight percentages) about 0.01% to about 0.2% carbon (C), about 0.3% to about 3% manganese (Mn), about 0.05% to about 2% silicon (Si), a combination of chromium (Cr) and Nickel (Ni) between about 0.2% and about 2% with about 0.1% to about 2% chromium (Cr) and up to about 1% by weight Nickel (Ni), not more than about 0.1% phosphorous (P), not more than about 0.03% sulfur (S), not more than about 0.02% nitrogen (N), about 0.01 to about 0.1% aluminum (Al), where the ratio of Al/N is more than about 2, not more than about 0.2% titanium (Ti), not more than about 0.2% vanadium (V), not more than about 0.2% niobium (Nb), not more than about 0.008% boron (B), not more than about 0.5% molybdenum (Mo), not more than about 0.8% copper (Cu), and about 0.0005 to about 0.01% calcium (Ca), the remainder essentially being iron (Fe) and raw material impurities.

ii. Hot roll the steel slab to form a hot rolled band and complete the hot rolling process at a termination or finishing temperature in a range between about ($A_{r3}$-30)° C. and about 950° C. (1742° F.). The total draft or reduction used during hot rolling is more than 50%, and may be more than 75%.

iii. Cool the hot-rolled steel sheet immediately after completing hot rolling at a mean cooling rate not slower than about 10° C./s (18° F./s) to a temperature not higher than about 650° C. (1202° F.).

iv. Coil the hot rolled steel on a coiler, starting the coiling process when the hot band has cooled to a temperature above the martensite formation temperature. The cooling temperature may be higher than about 450° C. (842° F.) and lower than about 650° C. (1202° F.). Starting the coiling when the hot band has cooled to a temperature not higher than about 650° C. (1202° F.) may result in better formability and drawability properties. When cooled, the coiled sheet is at a temperature lower than the martensite formation temperature to form martensite islands dispersed in a ferrite matrix phase, where the martensite is between about 3% and 30% by volume.

v. Pickle the above hot rolled coil, as an optional step, to improve the surface quality.

vi. At ambient temperature, cold roll the hot rolled and optionally pickled coil to a desired thickness, with the total cold rolling reduction being between about 45% and about 85%.

vii. Transfer the cold rolled steel sheet to a conventional batch annealing furnace (also known as a box annealing furnace), and batch anneal the sheet in the batch furnace at a temperature higher than about 650° C. (1202° F.) and lower than about the $A_{c1}$ temperature in the subcritical temperature region.

viii. Cool the annealed steel sheet to a temperature lower than about 300° C. (572° F.). The cooling may be directly to the ambient temperature.

ix. Optionally, hot dip plating or electroplating may be performed to apply a zinc coating and/or a zinc alloy coating onto the surface of the above cold rolled and annealed steel sheet to improve the corrosion resistance. Either the "as-annealed" sheet or coated sheet may be formed or press formed into the desired end shapes for any final applications.

In the disclosed process, a starting material steel slab thicker than about 100 millimeter (mm) may be employed. For instance, the steel slab thickness may be about 150 mm or thicker, or about 200 mm or yet thicker, or about 300 mm and thicker. Such a steel slab employed as a starting material, with the above-noted chemical composition, can be produced in an integrated hot mill by continuous casting or by ingot casting. For a thicker slab produced in an integrated mill, a reheating process may be required before conducting the above-mentioned hot rolling operation, by reheating the steel slab to a temperature in a range between about 1050° C. (1922° F.) and about 1350° C. (2462° F.) and more typically between about 1100° C. (2012° F.) and about 1300° C. (2372° F.), and then holding at this temperature for a time period of not less than about 10 minutes and more typically not less than about 30 minutes. The reheating helps to assure the uniformity of the initial microstructure of the thick slabs before conducting the hot rolling process of the present disclosure. On the other hand, for a thin slab (under about 100 mm) cast as occurs in a CSP plant, the reheating process is usually not needed unless the slab is cooled. FIG. 1 is a process flow diagram which illustrates the above-described steps of the presently disclosed process.

Several types of low carbon molten steels were made using an electric arc furnace and were then formed into thin slabs with a thickness of about 53 millimeter at the Nucor-Berkeley compact strip production plant. For example, steel samples DP-1 and DP-2 were steels with compositions according to the present disclosure and were manufactured according to the presently disclosed process. DP-1 had a microstructure with a martensite phase of about 11% by volume. DP-2 had a microstructure with a martensite phase of about 16% by volume.

DP was a comparison steel. The chemical composition of the steel DP fell within the ranges of the present invention; however, the steel DP was manufactured using a continuous annealing method disclosed in the above-noted prior patents and published patent application. Steel sample DP was a dual phase steel having a microstructure with a martensite phase and a ferrite phase, where the martensite phase was about 37% by volume and the ferrite phase was within a range from 50% to 60% by volume.

CMn-1 and CMn-2 were comparison steels. They were conventional low carbon-manganese grades for deep drawing and/or other commercial applications manufactured using a batch annealing method. HSLA-1 and HSLA-2 also were comparison steels. They were conventional high strength low allow steels that were also manufactured by a batch annealing method.

A steel slab for each of these steels was hot rolled to form hot bands using hot rolling termination temperatures (also called finishing or exit temperatures) ranging from 870° C. (1598° F.) to 930° C. (1706° F.). The total reduction used during hot rolling was more than 85%. Immediately after hot rolling, the hot rolled steel sheets were water cooled at a conventional run-out table at a mean rate of at least about 5° C./s (about 9° F./s) and coiled at coiling temperatures ranging from 500° C. (932° F.) to 650° C. (1202° F.). After hot rolling, the hot bands were pickled to improve surface quality and then cold rolled at a conventional reversing cold rolling mill at ambient temperature to obtain the final thickness of the cold rolled steel sheets ranging from 1.21 millimeters to 1.57 millimeters, as noted below in TABLE 2. In the above-mentioned step, the total cold reduction was set in a range of 50% to 75%.

Subsequently, the cold rolled steel sheets of DP-1, DP-2, CMn-1, CMn-2, HSLA-1 and HSLA-2 were batch annealed. The batch annealing temperature was set between 650° C. (1202° F.) and the corresponding $A_{c1}$ temperature. The cold rolled steel sheet of DP was annealed on a continuous annealing line at a temperature between the corresponding $A_{c1}$ and $A_{c3}$ temperatures according to the prior patents.

The specific process conditions for DP-1 and DP-2 follow: The hot rolling termination temperature (also called the finishing exit temperature) was 885° C. (1625° F.) for DP-1 and was 877° C. (1610° F.) for DP-2. The total hot rolling reduction for DP-1 was about 90%, and for DP-2 was about 93%. Cooling the hot rolled steel, after completing hot rolling, was at a mean rate of at least 10° C./s (18° F./s) for both DP-1 and DP-2. The coiling temperature was about 591° C. (1095° F.) for DP-1 and was about 552° C. (1025° F.) for DP-2. The cold reduction was about 68% for both DP-1 and DP-2. The batch annealing temperature at the hot spot (namely, the relatively hot area of the coil during annealing) was about 700° C. (1292° F.) for both DP-1 and DP-2. The batch annealing temperature measured at a "cold spot" (namely, a relatively lower temperature portion of the coil during annealing) was about 678° C. (1252° F.) for both DP-1 and DP-2.

The compositions of these various steels are presented below in TABLE 1. Recently, additional dual phase steel of the present disclosure was produced, having compositions shown in TABLE 1 (continued).

TABLE 1

| | Steel Type (Present Invention) | | Steel Type (Comparisons) | | | | |
|---|---|---|---|---|---|---|---|
| | DP-1 | DP-2 | DP | CMn-1 | CMn-2 | HSLA-1 | HSLA-2 |
| Method of annealing | batch | batch | continuous | batch | batch | batch | batch |
| Starting Thickness (mm) | 53 | 53 | 53 | 53 | 53 | 53 | 53 |
| C (wt %) | 0.039 | 0.046 | 0.045 | 0.018 | 0.041 | 0.043 | 0.050 |
| Mn (wt %) | 1.632 | 1.568 | 1.596 | 0.178 | 0.273 | 0.797 | 1.305 |
| Si (wt %) | 0.335 | 0.962 | 0.200 | 0.034 | 0.022 | 0.024 | 0.030 |
| P (wt %) | 0.024 | 0.022 | 0.015 | 0.005 | 0.009 | 0.041 | 0.010 |
| S (wt %) | 0.001 | 0.002 | 0.002 | 0.004 | 0.002 | 0.005 | 0.005 |
| Al (wt %) | 0.050 | 0.039 | 0.042 | 0.047 | 0.035 | 0.032 | 0.025 |

TABLE 1-continued

| | | | | | | | |
|---|---|---|---|---|---|---|---|
| Ca (wt %) | 0.0027 | 0.0032 | 0.0036 | trace | trace | trace | trace |
| Cr (wt %) | 0.911 | 0.821 | 0.785 | 0.020 | 0.036 | 0.052 | 0.038 |
| Nb (wt %) | 0.006 | 0.006 | 0.006 | 0.002 | 0.002 | 0.029 | 0.006 |
| V (wt %) | 0.010 | 0.002 | 0.008 | trace | trace | 0.004 | 0.020 |

| | Steel Type (Present Invention) | | | | | |
|---|---|---|---|---|---|---|
| | DP-3 | DP-4 | DP-5 | DP-6 | DP-7 | DP-8 |
| C (wt %) | 0.058 | 0.045 | 0.042 | 0.056 | 0.052 | 0.045 |
| Mn (wt %) | 1.588 | 1.591 | 1.611 | 1.61 | 1.553 | 1.633 |
| Si (wt %) | 0.915 | 0.343 | 0.316 | 0.665 | 0.667 | 1.058 |
| P (wt %) | 0.009 | 0.008 | 0.014 | 0.011 | 0.012 | 0.013 |
| S (wt %) | 0.0005 | 0 | 0 | 0.004 | 0.003 | 0.0001 |
| Al (wt %) | 0.046 | 0.041 | 0.046 | 0.031 | 0.052 | 0.046 |
| Ca (wt %) | 0.0018 | 0.0048 | 0.0031 | 0.0021 | 0.0033 | 0.0021 |
| Cr + Ni (wt %) | 0.855 | 0.892 | 0.861 | 0.736 | 0.833 | 0.896 |
| Nb (wt %) | 0.007 | 0.004 | 0.029 | 0.039 | 0.005 | 0.002 |
| Ti (wt %) | 0.015 | 0.015 | 0.02 | 0.072 | 0.018 | 0.012 |
| Mo (wt %) | 0.016 | 0.019 | 0.132 | 0.027 | 0.018 | 0.008 |

Test pieces were taken from the resulting cold rolled and annealed steel sheets, and were machined into tensile specimens in the longitudinal direction, namely along the hot and cold rolling direction, for testing of the respective mechanical properties of the various steel sheets.

Tensile testing was conducted in accordance with the standard ASTM A370 method to measure the corresponding mechanical properties, including yield strength, tensile strength, and total elongation. The strain hardening exponent, known as the n-value, was determined in accordance with the ASTM E646 method by the slope of the "best fit line" between 10% and 20% strain. The test data obtained are presented below in TABLE 2.

TABLE 2

| | Steel Type (Present Invention) | | Steel Type (Comparisons) | | | | |
|---|---|---|---|---|---|---|---|
| | DP-1 | DP-2 | DP | CMn-1 | CMn-2 | HSLA-1 | HSLA-2 |
| Method of annealing | batch | batch | continuous | batch | batch | batch | batch |
| Test thickness (mm) | 1.57 | 1.21 | 1.47 | 1.45 | 1.52 | 1.35 | 1.45 |
| Yield strength (MPa) | 306 | 398 | 411 | 196 | 235 | 348 | 387 |
| Tensile strength (MPa) | 465 | 538 | 618 | 308 | 351 | 475 | 478 |
| Total elongation (%) | 28 | 28 | 22 | 41 | 35 | 26 | 26 |
| n-value (10% to 20%) | 0.204 | 0.202 | 0.159 | 0.210 | 0.101 | 0.173 | 0.156 |

As can be seen from TABLE 2, batch annealed dual phase steels according to the present process (DP-1 and DP-2) demonstrated higher total elongation and n-value than continuous annealed dual phase steels (DP). Additionally, the present batch annealed dual phase steel (DP-1 and DP-2) had higher yield strength and tensile strength than conventional batch annealed low carbon-manganese steels (CMn-1 and CMn-2). Also, the batch annealed dual phase steels according to the presently disclosed process (DP-1 and DP-2) demonstrated higher total elongation and n-value than conventional batch annealed high strength low alloy steels (HSLA-1 and HSLA-2).

Figure 2:
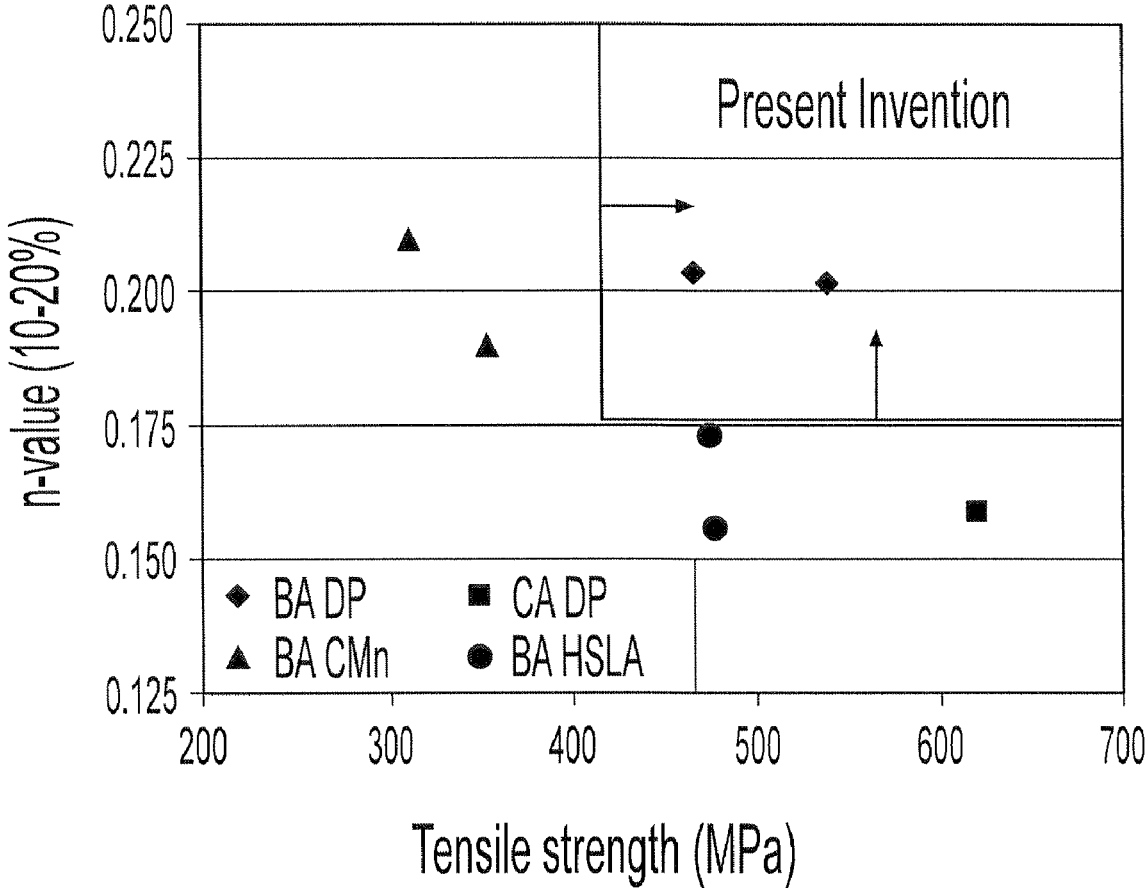
FIG. 2 is a graph of the tensile strength versus the n-value for certain embodiments of steel sheet in accordance with the present invention as compared to those properties of various comparison steel sheets.

The n-value is a property parameter used to evaluate the formability of a steel sheet. The n-values obtained for the above steels are also presented in the graph of FIG. 2 as a function of tensile strength. As shown in this graph, the dual phase steel sheets manufactured according to the present process exhibited a superior combination of strength and formability, and provided a much higher strength level with a similar formability compared to batch annealed low carbon-manganese steel, and a comparable strength level but a much improved formability compared to conventional batch annealed high strength low alloy steels, as well as continuous annealed dual phase steels.

Figure 3:
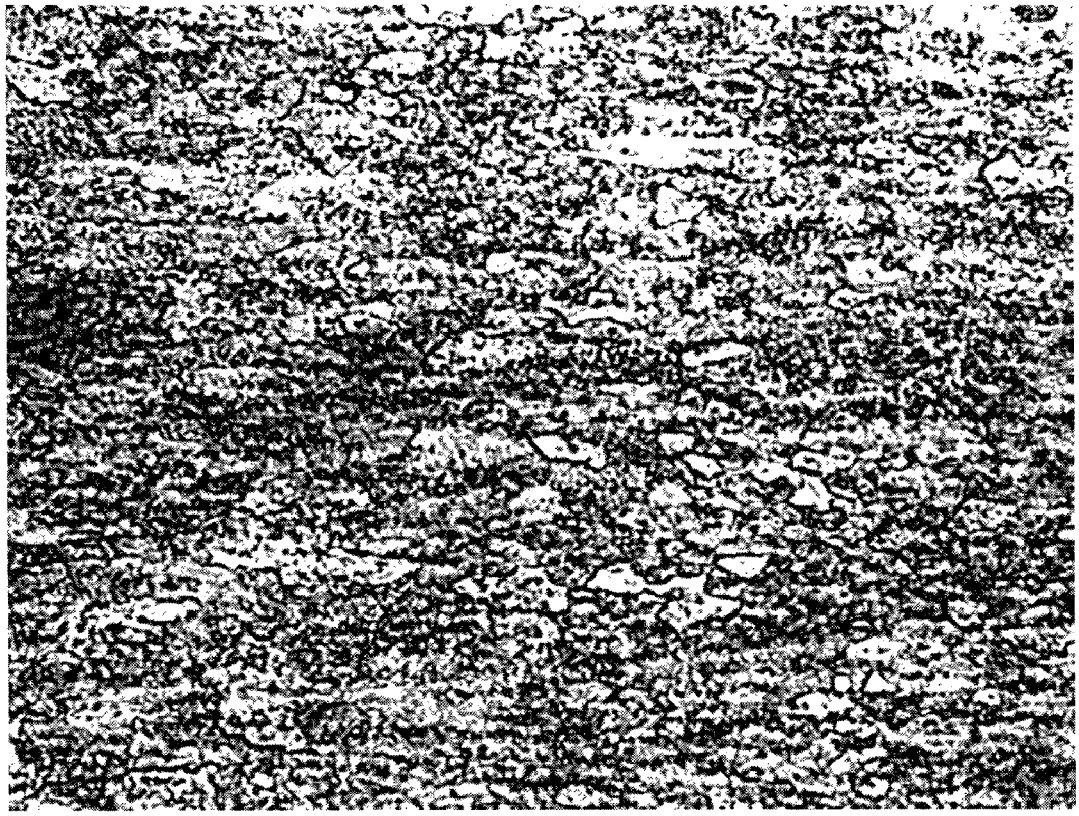
FIG. 3 is a photograph taken through a microscope of one embodiment of a steel sheet in accordance with the present invention.

The microstructure of the present cold rolled dual phase steel sheets was examined. One of the typical micrographs obtained using a Nikon Epiphot 200 Microscope is given in FIG. 3. As illustrated by this micrograph, martensite islands are substantially uniformly distributed in the continuous ferrite matrix. It is such a dual phase structure that provides the excellent combination of strength and formability for the presently disclosed steel sheet.

Although the present invention has been shown and described in detail with regard to only a few exemplary embodiments of the invention, it should be understood by those skilled in the art that it is not intended to limit the invention to specific embodiments disclosed. Various modifications, omissions, and additions may be made to the disclosed embodiments without materially departing from the novel teachings and advantages of the invention, particularly in light of the foregoing teachings. Accordingly, it is intended to cover all such modifications, omissions, additions, and equivalents as may be included within the spirit and scope of the invention as defined by the following claims.

What is claimed is:

1. A batch annealing method of making a dual phase steel sheet, comprising:

(I) hot rolling a steel slab into a hot band and completing the hot rolling process at a termination temperature in a range between about ($A_{r3}$-60)° C. and about 980° C. (about 1796° F.), where the steel slab comprises a composition comprising:

carbon in a range from about 0.01% by weight to about 0.2% by weight, manganese in a range from about 0.3% by weight to about 3% weight, silicon in a range from about 0.05% by weight to about 2% by weight, chromium and nickel in combination from about 0.2% by weight to about 2% by weight where the chromium if present is in a range from about 0.1% by weight to about 2% by weight and nickel if present is in an amount up to about 1% by weight, aluminum in a range from about 0.01% by weight to about 0.10% by weight and nitrogen less than about 0.02% by weight, where the ratio of Al/N is more than about 2, and calcium in a range from about 0.0005% by weight to about 0.01% by weight, with the balance of said composition comprising iron and incidental ingredients;

(II) cooling the hot band at a mean rate of at least about 5° C./s (about 9° F./s) to a temperature not higher than about 750° C. (about 1382° F.);

(III) coiling the band to form a coil at a temperature higher than the martensite formation temperature;

(IV) cooling the coil to a temperature lower than the martensite formation temperature to form a dual phase microstructure comprising a martensite phase of less than 35% by volume and a ferrite phase of more than; 65% by volume;

(V) cold rolling the coil to a desired steel sheet thickness, with a total reduction of at least about 35%;

(VI) annealing the cold rolled steel sheet in a batch furnace at a temperature higher than about 500° C. (about 932° F.) and lower than about the $A_{c3}$ temperature for longer than about 60 minutes;

(VII) cooling the annealed steel sheet to a temperature lower than about 400° C. (about 752° F.), and (VIII) obtaining a steel sheet comprising (a) a dual phase microstructure comprising a martensite phase of no more than 35% by volume and embedded in a ferrite matrix phase, (b) said composition, and (c) properties comprising a tensile strength of at least about 400 megapascals and an n-value of at least about 0.175.

2. The method of claim 1, where the properties comprise a tensile strength of about least about 450 MPa, and an n-value of at least about 0.18.

3. The method of claim 1, step (IV), where the ferrite phase comprises between more than 65% and less than or equal to 90% by volume.

4. The method of claim 1, step (IV), where the ferrite phase comprises more than 70% by volume.

5. The method of claim 1, step (IV), where the martensite phase comprises from about 3% by volume to about 30% by volume of the microstructure.

6. The method of claim 1, step (IV), where the martensite phase comprises from about 8% by volume to about 30% by volume.

7. The method of claim 1, step (IV), where the martensite phase comprises from about 10% by volume to about 28% by volume.

8. The method of claim 1, where the composition further comprises one or more of:

titanium in an amount up to about 0.2% by weight; vanadium in an amount up to about 0.2% by weight; niobium in an amount up to about 0.2% by weight; boron in an amount up to about 0.008% by weight; molybdenum in an amount up to about 0.5% by weight;

copper in an amount up to about 0.8% by weight; phosphorous in an amount up to about 0.1% by weight; and sulfur in an amount up to about 0.03% by weight.

9. The method of claim 1, where the carbon ranges from about 0.02% to about 0.12% by weight, the manganese ranges from about 0.5% to about 2.5% by weight, the silicon ranges from about 0.08% to about 1.5% by weight, the chromium ranges from about 0.2% to about 1.5% by weight, the aluminum ranges from about 0.015% to about 0.09% by weight, the calcium ranges from about 0.0008% to about 0.009% by percent.

10. The method of claim 9, where the carbon ranges from about 0.03% to about 0.1% by weight, the combination of chromium and nickel is in an amount between about 0.3% and about 1.5% by weight, the aluminum ranges from about 0.02% to about 0.08% by weight, the calcium ranges from about 0.001% to about 0.008% by percent.

11. The method of claim 1, where hot rolling is at a temperature in a range between about ($A_{r3}$-30)° C. and about 950° C. (about 1742° F.).

12. The method of claim 1, where cooling the hot band is at a mean rate of at least about 10° C./s (about 18° F./s) to a temperature not higher than about 650° C. (about 1202° F.).

13. The method of claim 1, further comprising pickling the coil.

14. The method of claim 1, where the total cold rolling reduction ranges from about 45% to about 85%.

15. The method of claim 1, where the annealing is a temperature higher than about 500° C. (about 932° F.) and lower than about the $A_{c1}$ temperature in the subcritical temperature region for a time from about 60 minutes to about 8 days.

16. The method of claim 1, where the annealing is a temperature higher than about 650° C. (about 1202° F.) and lower than about the $A_{c1}$ temperature in the subcritical temperature region for a time from about 180 minutes to about 7 days.

17. The method of claim 1, where cooling the annealed sheet is to a temperature from about 300° C. (about 572° F.) to about ambient temperature.

18. The method of claim 1, further comprising:

applying a coating of one or both of a zinc coating or a zinc alloy coating to the annealed steel sheet.

* * * * *

UNITED STATES PATENT AND TRADEMARK OFFICE

CERTIFICATE OF CORRECTION

PATENT NO. : 7,959,747 B2
APPLICATION NO. : 12/177839
DATED : June 14, 2011
INVENTOR(S) : Weiping Sun It is certified that error appears in the above-identified patent and that said Letters Patent is hereby corrected as shown below:

IN THE SPECIFICATION:

In column 3, line 52, "(J)" should read --(I)--.

IN THE CLAIMS:

In claim 1, column 16, line 4, "than;" should read --than--.

Signed and Sealed this
Twenty-fifth Day of October, 2011

David J. Kappos

David J. Kappos
*Director of the United States Patent and Trademark Office*